US006202232B1

(12) United States Patent
Andrei

(10) Patent No.: US 6,202,232 B1
(45) Date of Patent: Mar. 20, 2001

(54) PILLOW

(76) Inventor: Daniel Andrei, Zellerburg Str. 8, A-6630 Kufstein, Tirol (AT)

( * ) Notice: Subject to any disclaimer, the term of this patent is extended or adjusted under 35 U.S.C. 154(b) by 0 days.

(21) Appl. No.: 09/193,764

(22) Filed: Nov. 17, 1998

(30) Foreign Application Priority Data

Nov. 18, 1997 (DE) ..... 197 51 076

(51) Int. Cl.[7] ..... A47G 9/10
(52) U.S. Cl. ..... 5/636; 5/637
(58) Field of Search ..... 5/636, 637, 639, 5/640

(56) References Cited

U.S. PATENT DOCUMENTS

| | | | | |
|---|---|---|---|---|
| 3,753,264 | * | 8/1973 | Grenier | 5/636 X |
| 3,829,917 | * | 8/1974 | De Laittre et al. | 5/636 |
| 4,748,702 | * | 6/1988 | Sandler | 5/636 |
| 4,821,355 | * | 4/1989 | Burkhardt | 5/636 |
| 5,072,429 | * | 12/1991 | Mair | 5/639 X |
| 5,123,133 | * | 6/1992 | Albert | 5/639 |
| 5,138,732 | * | 8/1992 | Wattie et al. | 5/636 |
| 5,163,194 | * | 11/1992 | Dixon | 5/639 X |
| 5,313,678 | * | 5/1994 | Redewill | 5/639 |

FOREIGN PATENT DOCUMENTS

| | | | |
|---|---|---|---|
| 85 17 920 U | | 8/1985 | (DE) . |
| 195 24 488 A1 | | 7/1995 | (DE) . |
| 2196771 | | 3/1974 | (FR) . |
| 2144985 | * | 3/1985 | (GB) 5/636 |

* cited by examiner

*Primary Examiner*—Michael F. Trettel
(74) *Attorney, Agent, or Firm*—Andrei D. Popovici

(57) ABSTRACT

A pillow suitable for therapeutic purposes comprises an upper surface, shaped overall as a cradling surface which in a first cross-sectional direction B—B forms a trough 13 with lateral marginal bulges 14, 15 and in a second cross-sectional direction A—A, aligned across the first cross-sectional direction B—B forms a flat-convex middle bulge 12. When aligning said first cross-sectional direction B—B to the axis of the body, the pillow is particularly suitable for use when lying on one's side; when aligning the other cross-sectional axis A—A, the pillow is particularly suitable for use when lying on one's back.

12 Claims, 2 Drawing Sheets

PILLOW

BACKGROUND OF THE INVENTION

The invention relates to a pillow, in particular a pillow which due to its ergonomic shape is suitable for passive therapy and relaxation.

Humans spend about eight hours per day sleeping; if possible this time should be used to achieve optimal regeneration. In particular, during times of sleep, passive therapy for cervical syndromes should take place. Inter alia, such syndromes are also caused by the head's own weight pressing onto the cervical spine when the body is in the upright position; they manifest themselves in tenseness of the neck, stiffness of the neck as well as neck and back pain.

From DE-U-296 17 420 a pillow is known with the characteristics disclosed in the first part of claim 1. In this, trough-shaped areas are designed to provide straight-line support of the cervical spine region, both when lying on one's back and on one's side. The shape of pillow disclosed in this printed publication is apparently intended for use in a single orientation.

In the case of a further pillow, known from DE-A-195 24 488, at the margin a bulge has been provided with a depression in the middle to support the spinous process of the cervical spine; by contrast, the adjacent main surface of the pillow comprises an essentially flat supporting surface for the head itself. This design is intended to achieve load alleviation for the spine.

From DE 85 17 920 a further pillow is known whose supporting component, comprising cellular material, has a multitude of cam-like elevations pointing upward.

Overall, the upper surface is trough-shaped with an elevation at each of the four corners of the pillow.

SUMMARY OF THE INVENTION

The present invention provides a pillow which as far as possible is optimally designed both for lying on one's back and lying on one's side.

The pillow according to claim 1, in two cross-sectional directions aligned across each other, comprises two different profiles of which one is particularly adapted for a resting position lying on one's side (side position), and the other for a resting position lying on one's back (dorsal position). For each of the two resting positions the pillow offers two positions rotated by 180°.

The pillow disclosed in claim 2, of essentially square shape, is suitable for alternative side or dorsal position.

The design of the pillow according to claim 3 results in good head support even in the side position.

Claims 4 to 6 relate to suitable dimensions of the pillow according to the invention.

The equipment provided according to claims 7 and 8 is used for further relaxation.

BRIEF DESCRIPTION OF THE DRAWING

Below, basic considerations as well as a preferred embodiment of the invention are explained in more detail by means of drawings, showing the following.

DETAILED DESCRIPTION OF THE INVENTION

Figure 1:
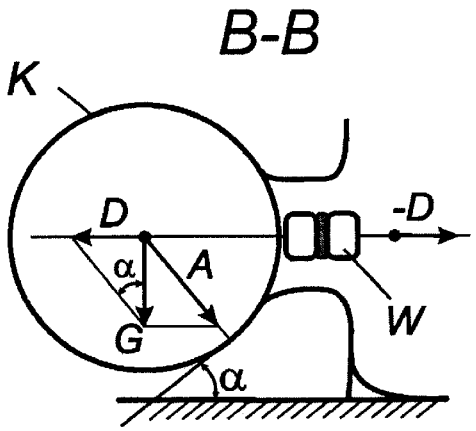
FIG. 1 a diagrammatic representation explaining the distribution of force in the side position.

As is diagrammatically shown in FIG. 1, when the head K (own weight G) rests against an incline with an inclination of a, two force-components result: namely a load pressure A and a tensile force D. Due to its much larger mass, the body exerts a reaction force -D against the tensile force.

The tension (dependent on the angle of inclination a) generated in this way from the weight of the head, which tension acts against the vertebrae W of the cervical spine, results in the desired load alleviation in the region of the cervical spine.

Figure 2:
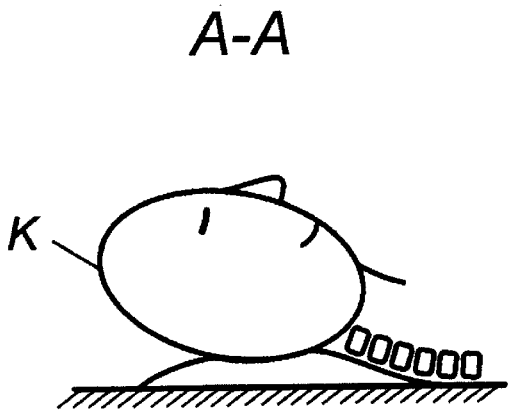
FIG. 2 a diagrammatic representation showing optimal head position in dorsal position.

As is diagrammatically shown in FIG. 2, in the dorsal position the supporting height of the head K should not be excessive, and the transition between the supporting surface of the body and the pillow should be gentle.

Figure 3:
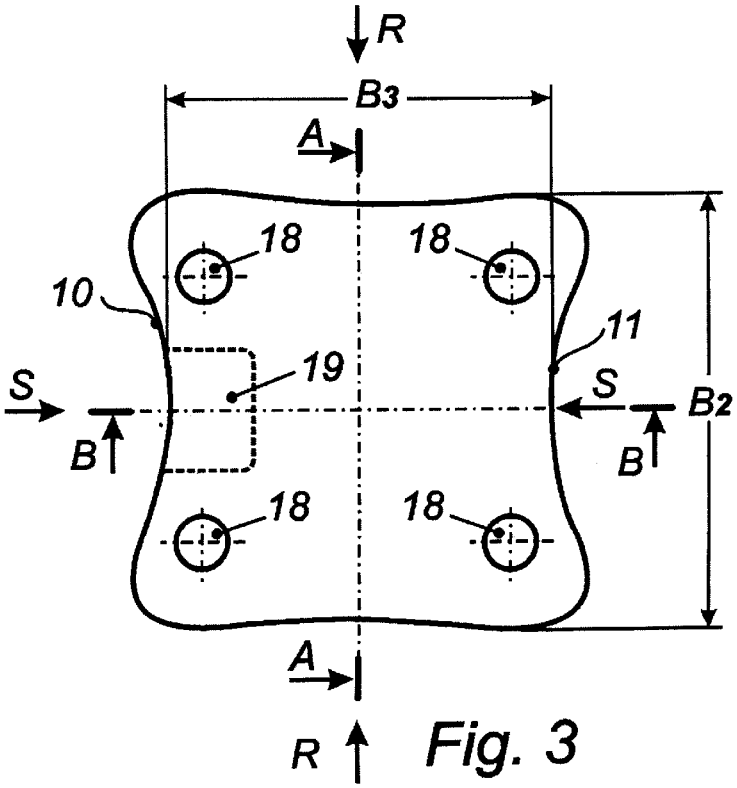
FIG. 3 a top view of an embodiment of the pillow according to the invention.
Figure 4:
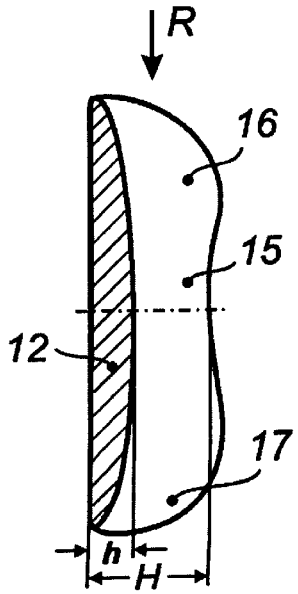
FIGS. 4 and 5 sections along the line A—A or the line B—B according to FIG. 3.
Figure 5:
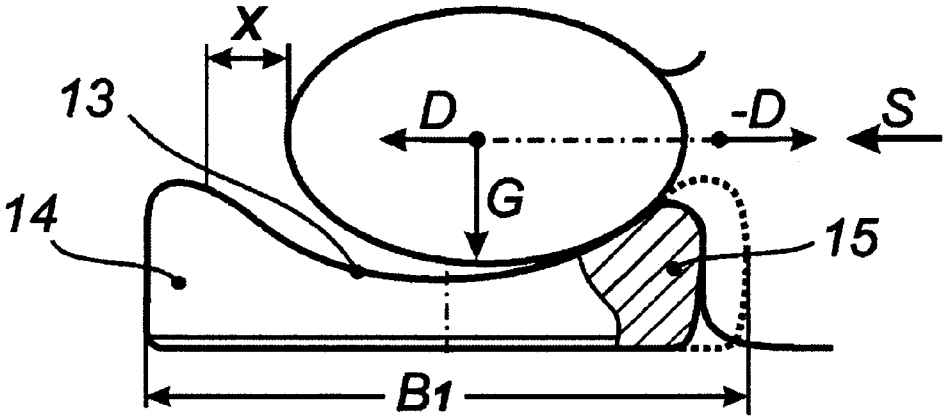

The requirements concerning optimal head support, explained by means of FIGS. 1 and 2, are incorporated in the pillow shown in FIGS. 3 to 5. As is shown, the pillow is of an essentially rectangular basic shape with rounded corners, with two opposite sides 10, 11 being slightly curved inward.

Overall, the upper surface of the pillow is shaped as a cradling surface which in the cross-sectional direction A—A shown in FIG. 4, forms a flat-convex middle bulge 12 and in the cross-sectional direction B—B shown in FIG. 5, perpendicular to A—A, forms a middle bulge 13 with lateral bulges 14, 15. T he pillow is symmetrical in respect of both cross-sectional planes A—A and B—B.

In the middle, the height h of the middle bulge 12 is between 30 and 120 mm. From the middle, the upper surface of the pillow in the cross-sectional direction A—A descends essentially in a gradual curve to a minimum height at both margins; with said height depending on the material of the pillow and, if applicable, on the pillow cover used.

In the middle, the marginal bulges 14, 15 are 70 to 200 mm in height H. On both sides of the middle, the marginal bulges 14, 15 rise to somewhat elevated cheeks 16, 17 before descending at the margin at essentially the same curvature .

In the cross-sectional direction A—A the total width Bi of the pillow is between 250 and 500 mm; in the cross-sectional direction B—B perpendicular to A—A, the total width B2 of the pillow is approx. 300 to 500 mm. The minimum width B3 between the inward curved areas of the sides 10, 11 is between 250 and 450 mm in the cross-sectional direction B—B. Overall, the pillow's basic shape is essentially square.

In FIGS. 3 to 5 the arrows R show the direction along which the pillow is to be oriented for resting in the dorsal position; the arrows S show the direction of orientation for resting in the side position.

FIG. 5 diagrammatically shows the position of the head in the orientation for resting in the side position. As is shown, in this position the respective marginal bulge 14, 15 is provided to adapt to the shoulder groove in the side position. In this, the cheeks 16, 17 (FIG. 4) which are somewhat raised in relation to the middle of the bulge, provide a stable middle position on the pillow. As shown in FIG. 5, the above dimensions are selected in such a way that a space X exists between the top of the head and the adjacent marginal bulge 14, so as to avoid pressure on the top of the head.

The core of the pillow preferably comprises latex or polyurethane foam of suitable hardness. Primarily cotton is envisaged as a cover material; an undercover made of lambswool may be provided between the core and the cover.

As indicated in FIG. 3, in the four corner regions of the pillow, loudspeakers 18 may be provided in the core of the pillow, with said loudspeakers being connected to a reception part 19, also contained in the core of the pillow, for wireless reception from an external transmitter. The reception part 19 is connected to a control part (not shown) accessible from the exterior on one side of the pillow. Instead of the reception part, a complete playback unit may also be provided.

What is claimed is:

1. A pillow of essentially rectangular basic shape, having a cradling upper surface which:

a) forms a trough with lateral marginal bulges in a first cross-sectional direction (B—B), for supporting a user in a lateral position; and b) forms a convex middle bulge in a second cross-sectional direction (A—A) transverse to said first cross-sectional direction (B—B), for supporting a user in a dorsal position.

2. The pillow of claim 1, of an essentially square basic shape.

3. The pillow of claim 1, wherein said marginal bulges have ends elevated relative to a rest of said marginal bulges.

4. The pillow of claim 1, wherein a width of said pillow in said first cross-sectional direction is between 300 and 500 mm.

5. The pillow of claim 1, wherein a central height H of said marginal bulges is between 70 and 150 mm.

6. The pillow of claim 1, wherein a central height h of said middle bulge is between 30 and 120 mm.

7. The pillow of claim 1, wherein said trough is sufficiently wide to accommodate a head of a user without pressing said head toward a neck of said user.

8. The pillow of claim 1, comprising loudspeakers in at least two adjacent regions.

9. The pillow of claim 8, further comprising an audio signal generator and a control part connected to said loudspeakers and accessible from the sides of said pillow.

10. The pillow of claim 1 wherein said trough is shaped such that a weight of a head of said user positioned in said trough in a lateral position exerts a tensile force pulling on a neck of said user.

11. A method of using a pillow, comprising the steps of:

a) resting a person's head in a side position along a first pillow direction, a cross-section of said pillow along said first direction forming a trough with lateral marginal bulges;

b) resting said head in a dorsal position along a second pillow direction transverse to said first pillow direction, a cross-section of said pillow along said second direction forming a convex middle bulge.

12. A dual-direction pillow optimized for alternative dorsal and side uses along transverse directions, comprising an upper surface forming:

a) along a first direction, a trough with lateral marginal bulges, shaped for accommodating a user in a side position, said trough being sufficiently wide to accommodate a head of said user without pressing said head toward a neck of said user; and b) along a second direction transverse to said first direction, a convex middle bulge of a lower height than said lateral marginal bulges, shaped for accommodating said user in a dorsal position.

* * * * *